US006966406B2

(12) United States Patent
Nash, Jr.

(10) Patent No.: US 6,966,406 B2
(45) Date of Patent: Nov. 22, 2005

(54) STEP PLATFORM ATTACHABLE TO A LADDER

(76) Inventor: Edward Lee Nash, Jr., 2120 Maple Dr., North Augusta, SC (US) 29860

( * ) Notice: Subject to any disclaimer, the term of this patent is extended or adjusted under 35 U.S.C. 154(b) by 0 days.

(21) Appl. No.: 10/774,165

(22) Filed: Feb. 6, 2004

(65) Prior Publication Data

US 2004/0163890 A1 Aug. 26, 2004

Related U.S. Application Data

(60) Provisional application No. 60/449,824, filed on Feb. 26, 2003.

(51) Int. Cl.[7] ..... E06C 7/16; E04G 3/08; E06B 7/28

(52) U.S. Cl. ..... 182/122; 182/120; 182/116; 248/238

(58) Field of Search ..... 182/120, 121, 182/122, 214, 107, 129, 45, 115, 116; 248/210, 248/238, 211; D24/68, 69

(56) References Cited

U.S. PATENT DOCUMENTS 1,820,315 A 8/1931 Miller
2,148,958 A 2/1939 Myers
2,486,783 A 11/1949 Hartman et al.
3,294,197 A 12/1966 Kwiatkowski
3,318,415 A * 5/1967 Christie, Sr. ..... 182/116
3,552,523 A 1/1971 Berkley
4,458,783 A * 7/1984 Stakes ..... 182/206
5,005,668 A 4/1991 Nowlan
5,020,757 A 6/1991 Sulecki et al.
5,052,515 A 10/1991 Nowlan
5,836,420 A 11/1998 Marky, Jr.
6,109,391 A 8/2000 Tyson
6,244,383 B1 6/2001 Jung

* cited by examiner

*Primary Examiner*—Hugh B. Thompson, II

(57) ABSTRACT

A ladder step platform can be mounted on any ladder having hollow rungs extending between ladder rails. This ladder step platform is especially intended for use with conventional extension ladders. The ladder step platform includes a tread or step plate extending between opposite side plates. The spacing between side plates can be adjusted so the ladder step platform will fit ladders of different width. A support rod insertable though hollow ladder rungs pivotally supports the ladder step platform with the side plates positioned on the outside of the ladder rails. A lower adjustable rod abuts the ladder rails to hold the tread or step plate in a horizontal orientation extending beyond the sloping ladder for easy access.

20 Claims, 6 Drawing Sheets

STEP PLATFORM ATTACHABLE TO A LADDER

This application claims the benefit of prior co-pending Provisional Patent Application Ser. No. 60/449,824 filed Feb. 26, 2003.

BACKGROUND OF THE INVENTION

1. Field of the Invention

This invention is related to a ladder step platform that will provide a stable support surface for the user of a ladder. The invention is also related to ladder step platforms that can be adjusted for use on different ladders and for use when the ladder is positioned at different orientations.

2. Description of the Prior Art

The prior art suggests that a ladder step platform can be added to ladders by employing a J-shaped strap or hook extending over one of the ladder rungs. The lower portion of these prior art ladder step platforms can engage either a lower rung or the ladder rails. These ladder step platforms provide a support surface area, on which a user of the ladder may stand, that is larger than the rung surface area. Representative examples of ladder step platforms, which extend beyond an inclined ladder, are shown in U.S. Pat. Nos. 2,486,783 and 3,294,197. Another example in which the ladder step platform is recessed relative to the ladder is shown in U.S. Pat. No. 5,836,420.

Although these prior art devices appear to be easy to use, there are significant differences between these devices and the ladder step platform comprising the preferred embodiment of this invention. Each of these prior art devices consists of a rigid assembly that can be mounted on a ladder. Since the straps or hooks are draped over the rungs between the ladder rails, the same device can be used on ladders having different widths. However, these devices are not adjustable and the width of the platform may not be equal to the width of the ladder on which it is to be used. Since the platform can only be as wide as the smallest ladder with which it is to be used, the available space for larger ladders may be less than desired. Furthermore since the straps or hooks are draped over the rungs between the ladder rails, they can interfere with latches that allow adjustment in the length of extension ladders. These straps and hooks could also interfere with the rope that is used to raise and lower the sections of an extension ladder. It is not possible to attach these prior art ladder step platforms on the outside of the ladder rails, as allowed by the preferred embodiment of this invention, where they will be no interference in the manipulation of the extension ladder. The hooks or straps of these prior art devices are also not attached to the ladder, and it appears that they can be inadvertently dislodged.

The instant invention is mounted on a ladder by inserting a support rod through hollow rungs of the type used on conventional metal and fiberglass extension ladders or fiberglass ladders or any other ladders having hollow rungs. The ladder step platform of the preferred embodiment of this invention cannot therefore be inadvertently dislodged, but it will also not interfere with adjustment hardware on conventional extension ladders. The instant invention can also be adjusted for use with ladders in which the spacing of the rails is different.

U.S. Pat. No. 6,109,391 does disclose a concept in which a scaffold can be supported by spaced ladders, and a mounting device is attached to a rod extending through hollow ladder rungs. However, this device employs a multi-link structure that also appears to be attached to a rod extending through a lower rail. This scaffold is mounted between the ladders and the structure on which the ladder is mounted so that a user can only stand between the ladders and there is no provision for use of a ladder step platform on either of the ladders used to support the scaffold.

Unlike these prior art devices, the ladder step platform according to this invention is also collapsible allowing assembly of the components on site and simplifying shipping and handling of this device when not in use. Furthermore it can be fabricated from simple metal stampings and can use conventional fasteners.

SUMMARY OF THE INVENTION

The ladder step platform of this invention can be used with conventional ladders to decrease discomfort and pain in one's legs and back, which can otherwise result from standing on a rung of a ladder for an extended period of time.

An adjustable ladder step platform, which according to this invention exhibits these capabilities, can be pivotally mountable at different elevations on a ladder. The ladder step platform includes a tread mounted between two side plates. Upper cylindrical projections extend inwardly from each side plate. These upper cylindrical projections form axle means insertable into a hollow ladder rung to pivotally mount the adjustable ladder step platform on the ladder. Abutments extend inwardly from each side plate below the cylindrical projections. These abutments are positioned to engage the ladder to prevent further rotation of the adjustable ladder step platform so that the tread can extend generally horizontally beyond the ladder to form a flat support surface providing a more stable support than the ladder rungs.

One version of this ladder step platform can be attached to and detached from a ladder having hollow rungs at different elevations on the ladder to provide a more stable support for a user of the ladder. This ladder step platform includes a tread spanning spaced apart parallel side plates, which extend substantially perpendicular relative to the tread. Each side plate has a mounting opening horizontally aligned with a mounting opening in the parallel spaced apart side plate. A support rod having a length greater than the spacing between spaced apart side plates is insertable through and detachable from the aligned upper openings and through a hollow rung flanked by the two spaced apart parallel side plates. A stop member is insertable through and removable from one of a series of lower openings in at least one of the spaced apart parallel side plates. This series of openings permits the stop member to be positioned at different distances from the support rod to adjust the angle of the ladder step platform relative to the ladder so the tread can be substantially positioned in a horizontal plane for different angular orientations of the ladder.

This step platform is mountable on a ladder at any elevation opposite any hollow rung on the ladder so that the step platform extends beyond the rung and the ladder. The step platform extension includes a tread with side plates on opposite ends of the tread and extending below the tread. Each side plate has at least one hole forming a pair of aligned holes. A first rod is insertable through the pair of aligned holes in the side plates an opposite ends of the tread. This first rod can be located adjacent a rear edge of the tread and is elevated above a second rod located below the tread. The first rod is insertable through the pair of aligned holes in the side plates and into a hollow rung positioned opposite the tread. The second rod can be positioned to engage a front edge of the ladder to support the step platform extending beyond the front edge of the ladder.

DETAILED DESCRIPTION OF THE PREFERRED EMBODIMENTS

Figure 1:
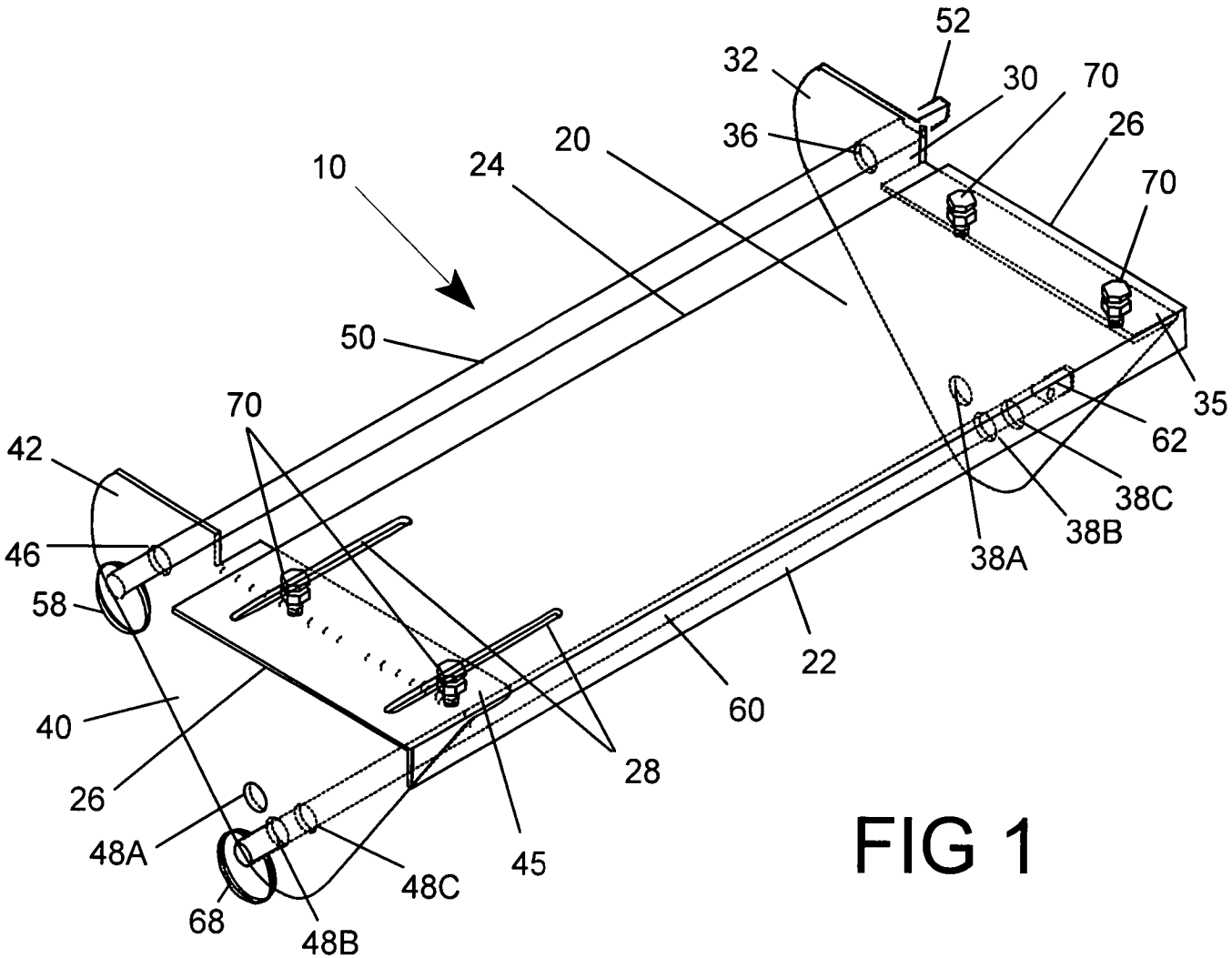
FIG. 1 is a three dimensional view of a ladder step platform, which can be added to a conventional ladder according to this invention.

The preferred embodiment of this invention is an adjustable ladder step platform 10 that can be mounted at any elevation on a ladder 2. This ladder step platform 10 can be mounted on ladders having a plurality of hollow rungs 6 extending between opposite rails 4. Conventional metal ladders employ hollow cylindrical rungs 6 in the form of tubes, which may have a gripping outer surface. Some fiberglass ladders also employ hollow rungs and this invention can be used with any ladders having hollow rungs. These rungs 6 extend through holes in the rails 4 and the interior of each rung 6 is accessible on opposite ends of the ladder 2. Hollow cylindrical rungs 6 are commonly used on metal and fiberglass extension ladders, and this invention is especially suited for use on extension ladders. Use of the ladder step platform 10 is not however limited to use with metal extension ladders.

Ladder step platform 10 includes a tread or step plate 20, two side plates 30 and 40, and upper support rod 50, a lower stop or abutment rod 60 as well as fasteners 70, locking clips 52 and 62, and pull rings 58 and 68. The two rods 50 and 60 are identical and interchangeable. Similarly the locking clips 52 and 62 and pull rings 58 and 68 are also part of the two identical rod subassemblies. Since these rod subassemblies are identical, they will be interchangeable when assembled on site to the ladder 2 and to the remaining components of the ladder step platform 10. FIG. 1 shows all of these components assembled to form the ladder step platform 10. The tread or step plate 20 will be accessible on the outside of a sloping ladder to provide a stable surface to support one using the ladder 2 or to provide a rest for equipment needed by the ladder user. In other words a sloping ladder 2 would be positioned along the rear edge of the ladder step platform as viewed in FIG. 1 as can be seen in the two opposite end views of FIGS. 4 and 5.

The tread or step plate 20 can be formed from a flat aluminum stock having a thickness of one-eight (⅛) inch or from other materials that can withstand the maximum anticipated weight of a potential user plus an acceptable safety margin. Aluminum step thread stock can be employed. The initially flat sheet or stock can be formed to produce a lip 27 along its front edge 22. In the preferred embodiment the tread 20 can have a length of approximately twenty (20) inches and a width of approximately six (6) inches after the front edge 22 is bent to form a three-fourths (¾) inch downwardly extending lip 27. Holes having a diameter of one-fourth (¼) inch can be drilled at one end 26 adjacent both the front edge 22 and the rear edge 24. These holes will receive fastener bolts to attach one end of the tread 20 to a side plate 30. Two slots 28, also having a width of one-fourth (¼) inch and length of four and one-fourth (¼) are formed adjacent the other end 26 so that the other side plate 40 can also be attached to the tread 20 at any point between opposite ends of the slots 28. The position of the side plate 40 can therefore be adjusted so that the same ladder step platform 20 can be mounted on ladders 2 having different widths. It should of course be understood that the dimensions for this tread or step plate 20, as well as the other components of the preferred embodiment, are representative only, and are included herein only to more completely describe one specific embodiment. Components having different dimensions can also be used in ladder step platforms in accordance with this invention.

Figure 2:
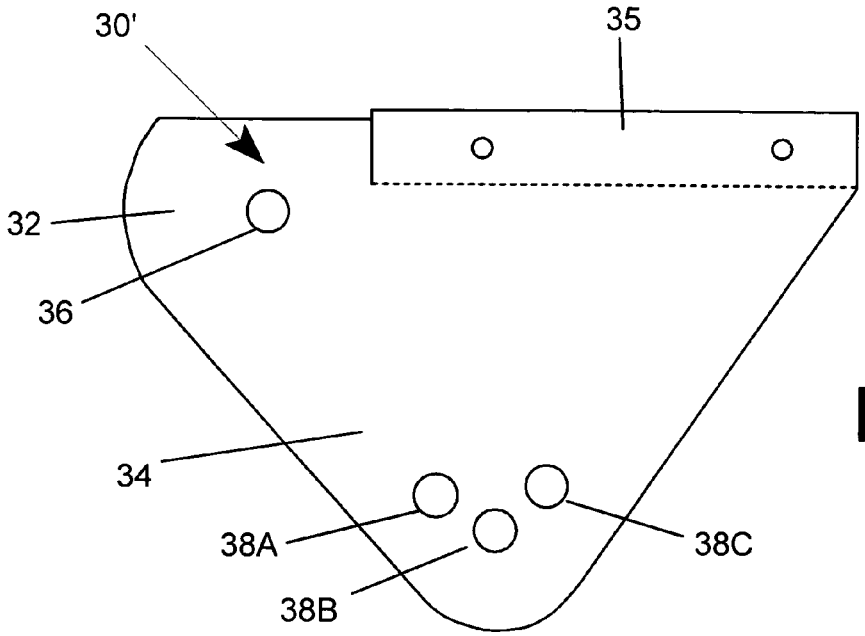
FIG. 2 is a view of a stamped metal blank from which one of the side plates of the ladder step platform can be fabricated.
Figure 3:
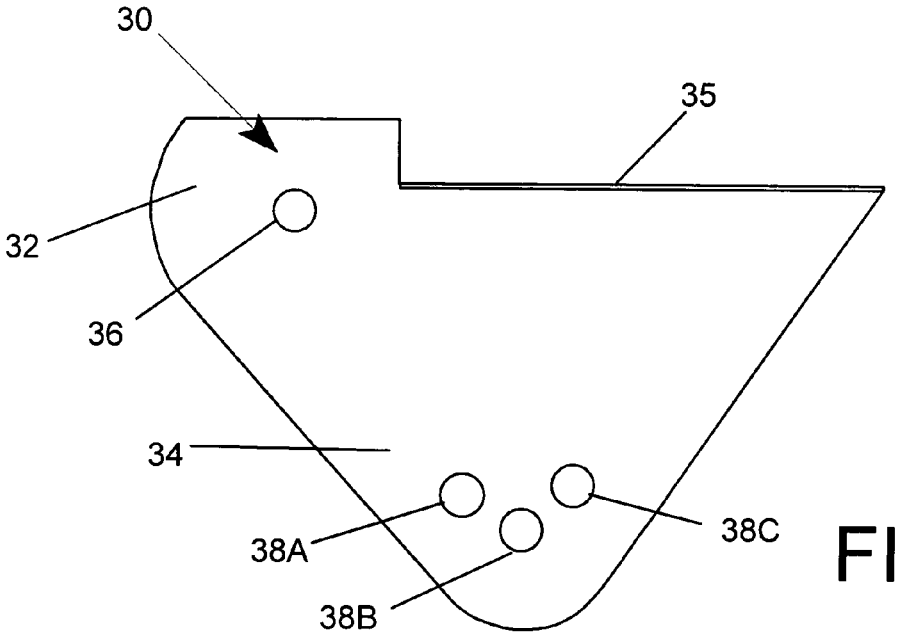
FIG. 3 is a view of one side plate after the stamped metal blank of FIG. 2 has been formed.
Figure 4:
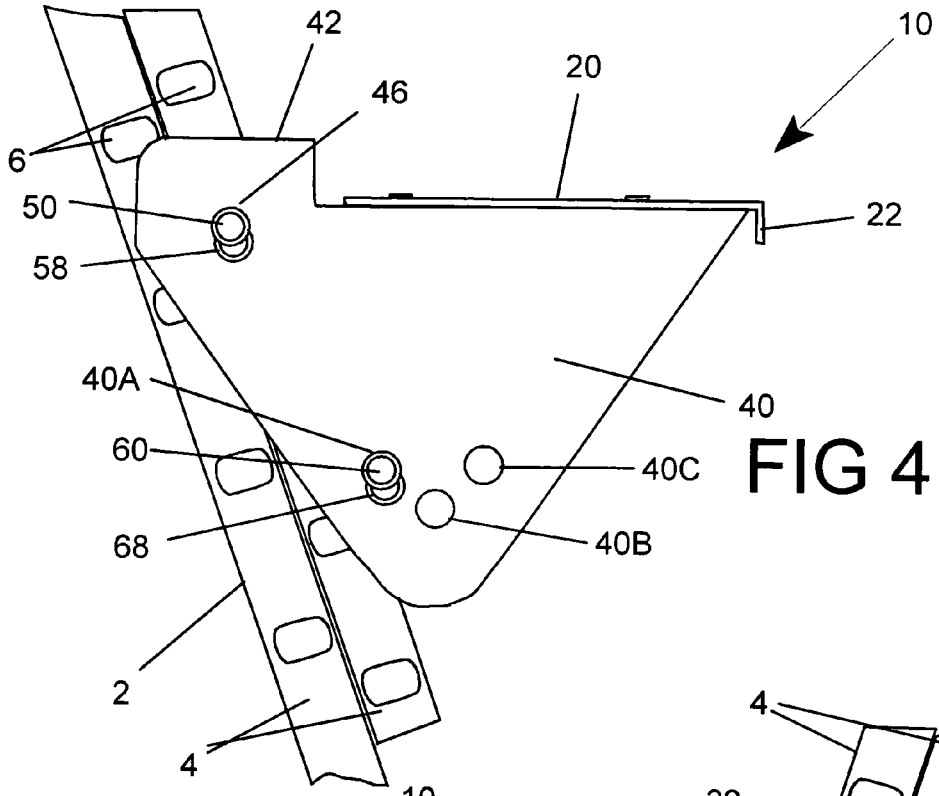
FIG. 4 is an end view showing the manner in which the ladder step platform of FIG. 1 is mounted on a ladder having hollow rungs.
Figure 5:
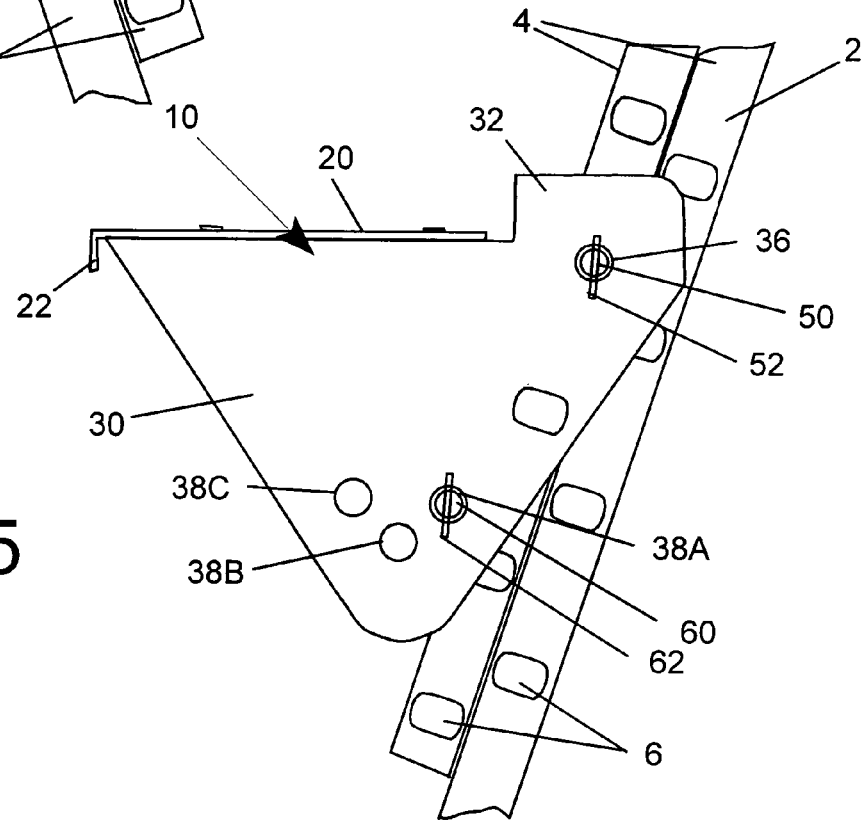
FIG. 5 is a view from the opposite end shown in FIG. 4.

One of the two side plates 30 is shown in FIGS. 2 and 3. In the representative embodiment depicted herein, the other side plate 40 will comprise the mirror image of side plate 30. FIG. 2 shows the flat blank 30' from which side plate 30 is formed. Side plate 40 can be formed from the same flat blank 30'. Both side plates 30 and 40 can be fabricated from one-eight (⅛) inch thick aluminum sheet metal. The maximum width of these roughly triangular shaped members can be approximately nine and three-eight (9⅜) inches with a projected height of six and five-eight (6⅝) inches. Side plate 30 includes an upper section 32 adjacent its rear, a lower section 34 and a folded section 35 extending between the upper section 32 and side plate front. The folded section 35 is formed at right angles relative to the remainder of the side plate 30 so that it can be attached to and support the tread or step plate 20. Part of this upper section 32 extends above the folded section 35 and an upper mounting hole having a diameter of nine-sixteenth (9/16) inch is formed in the upper section 32 slightly below the folded section 35. The lower section 34 includes three openings 38 A, B, C of similar size adjacent the lower apex of the triangularly shaped side plate 30. The distance of each of these lower holes 38 A, B, C from the upper mounting hole 36 is different. In addition to being located below the upper mounting hole 36, each of these lower holes 38 A, B, C is positioned closer to the front edge of the side plate 30. A single lower abutment or stop rod 60 can be inserted through either of these lower holes to adjust the orientation of the ladder step platform 10 in a manner that will be subsequently discussed in greater detail. The other side plate 40, which can be seen in FIGS. 1 and 4 is formed in a similar manner. Side plate 40 includes upper section 42, lower section 44, folded section 45, upper mounting hole 46 and lower holes 48 A, B, C. Upper mounting hole 46 will be axially aligned with opposite upper mounting hole 36 when the side plates 30 and 40 are attached to tread or step plate 20 to form the assembled ladder step platform 10. Similarly each of the lower mounting holes 48 A, B, C will be axially aligned with the corresponding lower mounting holes 38 A, B, C. In the preferred embodiment, the folded sections 35 and 45 extend toward each other when the side plates 30 and 40 are attached to the tread or step plate 20. This means that the folded sections 35 and 45 must be formed in opposite directions on the two side plates 30 and 40. It should be understood, however, that in an alternate embodiment, identical side plates can be used at opposite ends with the folded sections extending from the same side of the side plate. In this alternate configuration one folded section would extend toward the center of the tread or side plate and the other folded section would extend toward an end.

Two solid rods 50 and 60 are employed to mount the ladder step platform 10 to a ladder 2. The upper rod 50 will extend through axially aligned upper mounting holes 36 and 46 and can be inserted through hollow ladder rungs 6. The lower rod 60 can be inserted through any pair of correspondingly aligned holes 38 A, B, C and 48 A, B, C. The lower rod 60 is not inserted through a ladder rung 6 and does not engage any of the ladder rungs. Instead, the lower rod 60 abuts the front edge of the ladder rails 4 on opposite sides of the rungs 6 and prevents further rotation of the ladder step platform 10 relative to the ladder 2. Since the upper rod 60 extends through hollow ladder rungs 6, the entire ladder step platform 10 can pivot relative to the ladder 2. The ladder step platform 10 can pivot or rotate upward until the rear tread edge 24 abuts the ladder rails 4 so that the ladder step platform 10 can be folded partially out of the way. Downward rotation of the ladder step platform 10 is possible until the lower support rod 60 engages the rails 4 below the tread or step plate 20. Since the lower rod 60 can be inserted in either of the three pairs of holes, the ladder step platform 20 can be adjusted so that the tread or step plate 20 will be in a generally horizontal plane regardless of the slope of the ladder 2.

Figure 6:
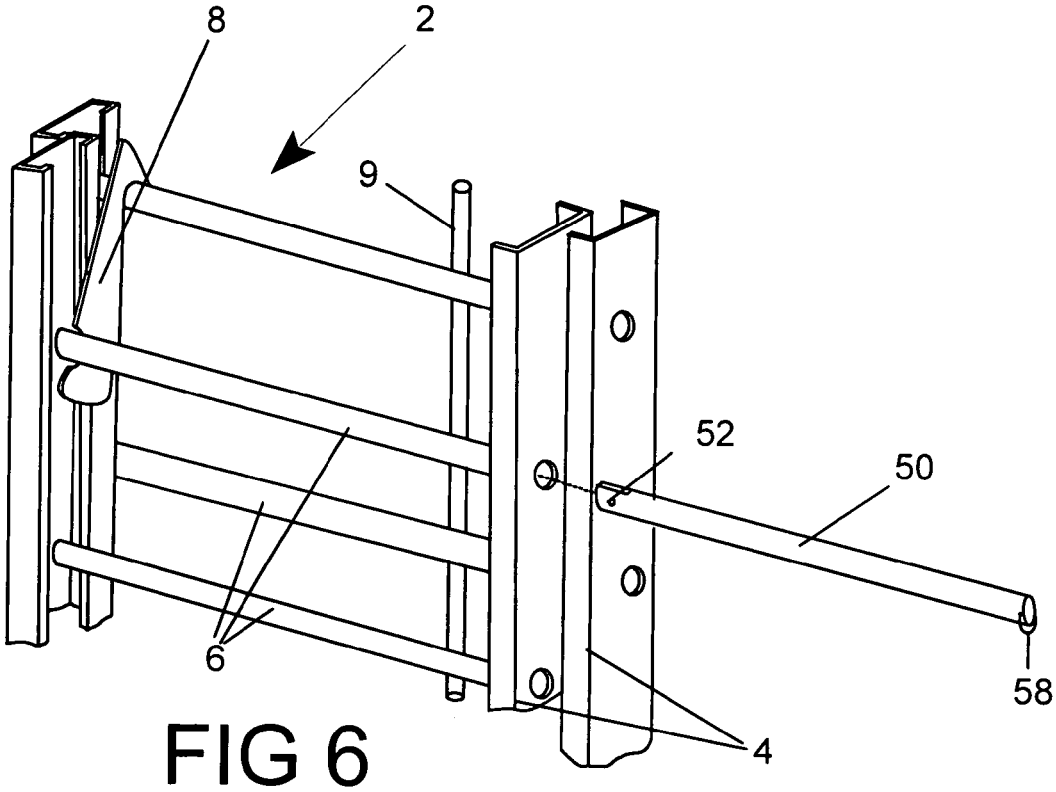
FIG. 6 is a view of a portion of an extension ladder showing the manner in which the support rod of the ladder step platform is inserted through an aligned hollow ladder rung.
Figure 7:
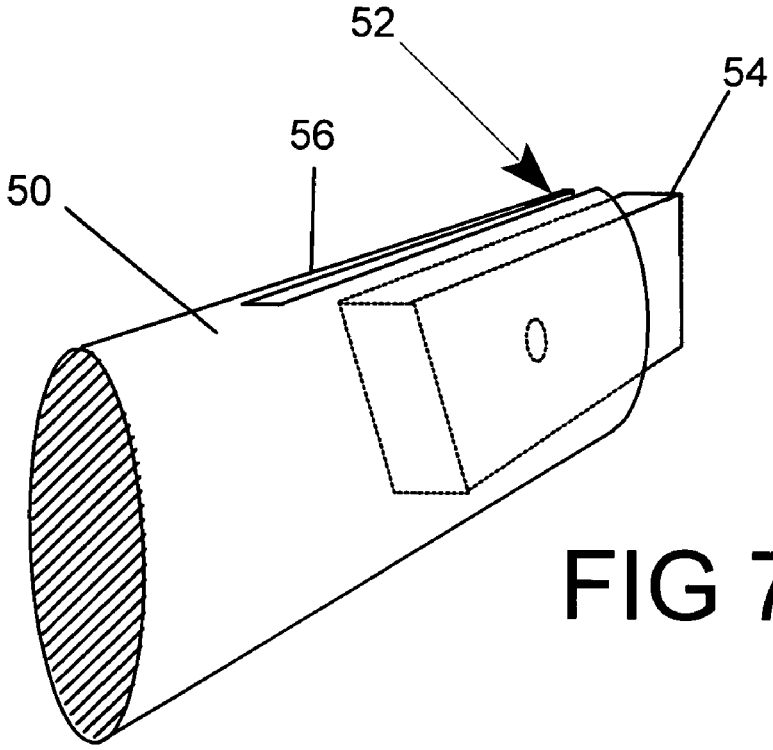
FIG. 7 is an enlarged view of a clip on one end of the rod, showing the clip in the recessed position.
Figure 8:
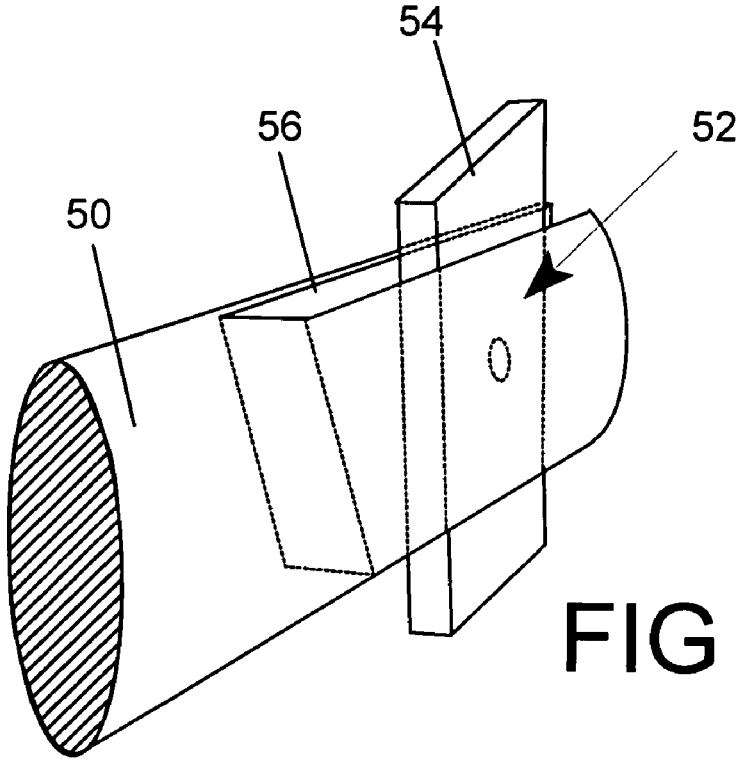
FIG. 8 is an enlarged view of the clip similar to FIG. 7, but showing the clip in a locking position.

The two rods 50 and 60 are interchangeable in the preferred embodiment of this invention. In the preferred embodiment the rods can be fabricated from galvanized steel so that these two load bearing members will provide adequate strength and load carrying capability. For instance steel rods capable of bearing a stress of approximately 700 pounds can be employed. In the representative embodiment depicted herein, the rods can have a length of twenty-one and ½ (21½) inches. Each rod 50 and 60 can include a through hole adjacent one end through which a pull ring 68 can be inserted. The opposite end of each rod will include a locking or swivel clip means, such as locking clip means 52 shown in FIGS. 7 and 8. Locking clip means 52 includes a rotatable locking bar 54 that can fit within a locking channel 54 extending inwardly from one end of the rod 50. The locking bar 54 can have an inner inclined surface, which abuts an inner inclined shoulder in the locking channel 56, so that the locking bar 54 can rotate in only one direction about a central mounting pin. The swiveling locking bar 54 can be rotated into the perpendicular position shown in FIG. 8 so tat the rod 50 cannot be inadvertently removed after being inserted through the ladder rungs 6. When the locking bar 54 is in the recessed position shown in FIG. 7, the rod 50 can be inserted through the hollow rungs 6 on conventional metal or fiberglass ladders 2 as illustrated in FIG. 6. The other identical rod 64) includes identical locking clip means 62 comprising rotatable locking bar in a locking channel.

The ladder step platform 10 can be assembled to a ladder 2 in the following manner. First the tread or step plate 20 is secured to the side plate 30 by two fastening means 70 in the form of conventional bolts extending through the holes in the folded section 35. The opposite side plate 40 can then be attached to the tread or step plate 20 by fasteners 70 extending through slots 28. In this way the spacing of the two side plates 30 and 40 can be adjusted to fit different ladders 2. In the preferred embodiment the ladder step platform 10 can be adjusted in this manner to fit ladders 2 having widths of between fifteen and eighteen (15–18) inches. After initial assembly of the side plates 30, 30 to the tread or step plate 20, the width can be adjusted by merely loosing the fasteners 70 extending through parallel slots 28 and sliding plate 40 to a desired position. The side plate 40 is adjusted so that both side plates 30, 40 will fit on the outside of the ladder rails 4. Positioning the side plates 30, 40 will prevent interference of the ladder step platform 10 with either latches 8 engaging a rung 8 used to secure an extension ladder 2 in its proper position a hoist line or rope 9 which is used to adjust the length of an extension ladder. Either before or after the side plate 40 has been fixed to the tread or step plate 20, the ladder step platform 10 is positioned so that the upper mounting holes 36, 46 are aligned with one of the hollow ladder rungs 6. Then the support rod 50, with the locking clip 52 in the recessed position is inserted first through one of the upper mounting holes 36 or 46 and then through the aligned ladder rung 6. FIG. 6 illustrates how the rod 50 can be inserted through a hollow rung. The other components of the ladder step platform 10 are not shown in FIG. 6 so that the various elements of a ladder 2, with which this invention can be used, are more clearly shown. After insertion of the support rod 50 through the remaining upper mounting hole 36 or 46, the locking bar is rotated to the locked position shown in FIG. 8 to prevent the rod 50 from slipping out of engagement with either end of the ladder step platform 10. At this point the partially assembled ladder step platform 10 will pivot relative to the ladder 2 with the upper rod 50 serving as an axle about which the remainder of the ladder step platform can rotate through a partial arc. The ladder step platform 10 is then positioned so that the tread or step plate 20 will extend horizontal and lower rod 60 is inserted through any of the three aligned pairs of lower holes 38 A, B, C or 48 A, B, C which will permit the tread or step plate 20 to be horizontal when the ladder is erected. The lower support rod 60 can be removed an inserted through any of the other pair of holes after the ladder has been positioned in engagement with a structure so that the tread or step plate 20 can be adjusted after the ladder is erected. The lower support rod 60 can be adjusted in this manner when the ladder 2 is moved or when an extension ladder 2, on which the ladder step platform 10 is mounted, is adjusted to a different height.

Figure 9:
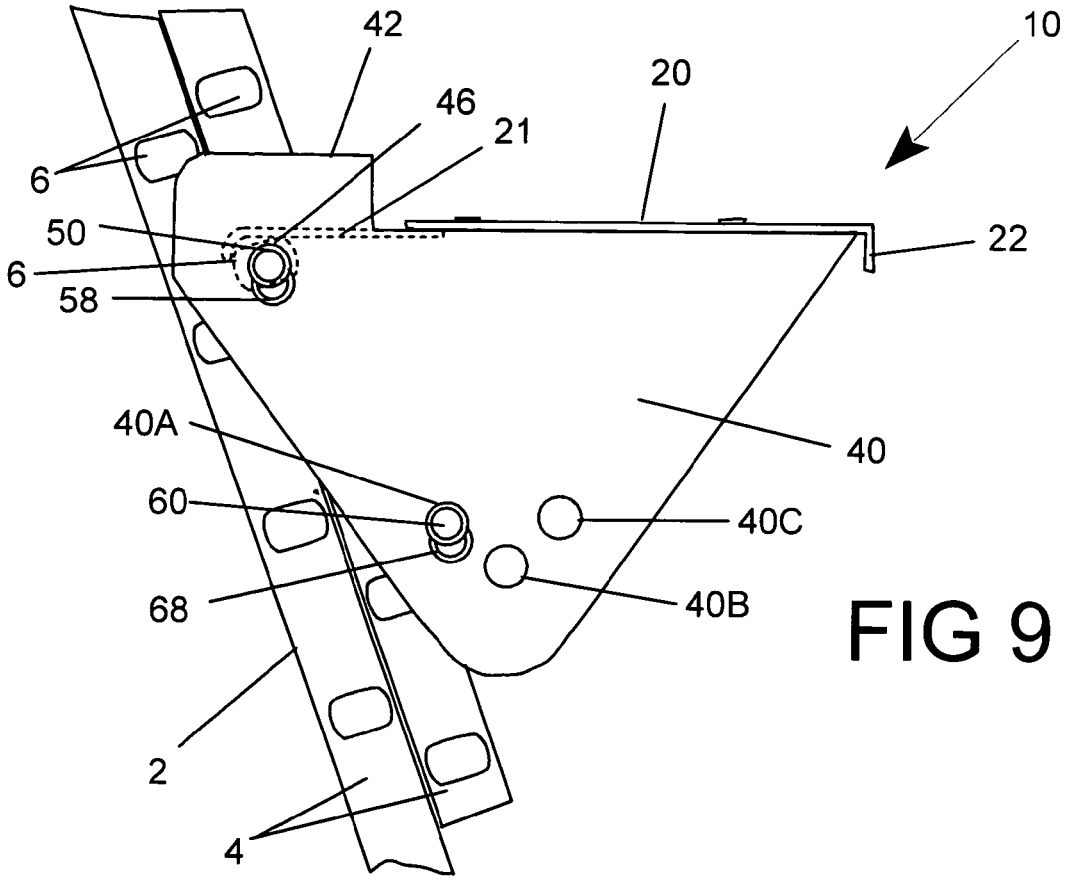
FIG. 9 is an end view, similar to FIG. 4, of an alternate embodiment of this invention.

An alternative method of mounting the ladder step platform 10 to the ladder 2 is to position the lower support rod 60 through any one of the pairs of aligned holes before inserting the upper mounting rod 50 through holes 36, 46 and through a hollow rung 6. This altered sequence is especially desirable if a strap 21 is attached to the tread or step plate 20 in an alternate embodiment. This strap 21 would extend rearwardly and could rest on top of a rung 6 as shown in FIG. 9. With the ladder step platform 10 positioned in this manner, the holes 36, 46 would be aligned with the hollow rung on which the strap 21 is positioned and insertion of the upper mounting rod 50 into place should be relatively easy. After the ladder step platform 10 is mounted in this manner, the lower support rod 60 could still be repositioned so that the tread or step plate 20 could extend horizontally.

The preferred embodiment of this invention is merely one representative embodiment of the invention defined in the following claims. Various modifications can be made to the preferred embodiment without departing from the scope and spirit of this invention. For example, it is not essential that the rods extend completely through the ladder rungs. Inwardly extending projections or protrusions can be formed on the side plates so that as the side plates are laterally adjusted the projections fixed to the side plates can enter the hollow ladder rungs from opposite ends. Rod-like projections can also be mounted to one or both side plates so that the rods can be spring loaded to a recessed position, but the rods can be pressed against the action of the springs and then locked into position extending into the hollow rungs for a sufficient depth to fix the ladder step platform pivotally to the ladder. Alternatively the lower abutment stop need not be a rod. For instance an eccentric cylindrical or cam shaped member rotatable relative to the side plates could be mounted at the lower end of each side plates. These eccentrically mounted member could then be rotated and locked into position when the tread or stop plate is properly oriented in a horizontal plane. These alternate versions are not intended to be all inclusive, but are merely examples of modifications that could be made to the preferred embodiment of this invention while still maintaining the functionality demonstrated by the embodiment depicted in FIGS. 1–8.

I claim:

1. An adjustable ladder step platform pivotally mountable at different elevations on a ladder, the ladder step platform including a tread mounted between two side plates and cylindrical protruding means extending inwardly from each side plate; the cylindrical protruding means forming axle means insertable into a hollow ladder rung to pivotally mount the adjustable ladder step platform on the ladder; and abutment means extending inwardly from each side plate below the cylindrical protruding means, the abutment means being positioned to engage the ladder to prevent further rotation of the adjustable ladder step platform so that the tread extends generally horizontally beyond the ladder to form a flat support surface providing a more stable support than the ladder rungs, wherein each side plate comprises a one piece member supporting the tread.

2. The adjustable ladder step platform of claim 1 wherein the cylindrical protruding means comprises a single rod insertable through a hollow ladder rung and extending through both side plates.

3. The adjustable ladder step platform of claim 1 wherein the abutment means comprises a rod.

4. The adjustable ladder step platform of claim 3 wherein each side plate includes a series of pairs of aligned holes, each pair of aligned holes being capable of receiving a single rod, the series of pairs or aligned holes being mutually positioned to allow adjustment of the ladder so that the tread can be positioned substantially horizontally when the ladder is positioned at different angles.

5. The adjustable ladder step platform of claim 1 wherein the side plates are attachable to the tread, at least one of the side plates being laterally adjustable relative to the tread so that the adjustable ladder step platform can be mounted on ladders having differing widths.

6. A ladder step platform attachable to and detachable from a ladder having hollow rungs at different elevations on the ladder to provide a more stable support for a user of the ladder, the ladder step platform comprising:

a tread spanning spaced apart parallel side plates extending substantially perpendicular relative to the tread, each side plate having a mounting opening horizontally aligned with a mounting opening in the parallel spaced apart side plate;

a support rod having a length greater than the spacing between spaced apart side plates, the support rod being insertable through and detachable from aligned upper openings in the side plates and through a hollow rung flanked by the two spaced apart parallel side plates; and a stop member insertable through and removable from one of a series of lower openings in at least one of the spaced apart parallel side plates, the series of openings comprising means for positioning the stop member at different distances from the support rod to adjust the angle of the ladder step platform relative to the ladder so the tread can be substantially positioned in a horizontal plane for different angular orientations of the ladder, wherein each side plate comprises a one piece member supporting the tread.

7. The ladder step platform of claim 6 wherein the stop member comprises a stop rod insertable through each or a series of aligned openings in both spaced apart parallel side plates.

8. The ladder step platform of claim 7 wherein the stop rod is insertable and removable through the series of aligned openings while the support rod remains engaged with the ladder.

9. The ladder step platform of claim 6 wherein the spaced apart parallel side plates are attachable to the tread, at least one of the side plates being attachable at different lateral locations on the tread so that the side plates can be positioned to flank both rails of ladders having different widths.

10. The ladder step platform of claim 6 including locking means on opposite ends of the support rod so that the support rod cannot be removed from the upper openings without disengagement of the locking means.

11. A step platform mountable on a ladder at any elevation opposite any hollow rung on the ladder so that the step platform extends beyond the rung and the ladder, the step platform comprising:

a tread;

side plates on opposite ends of the tread and extending below the tread, each side plate having at least one hole forming a pair of aligned holes; and at least one first rod insertable through the pair of aligned holes in the side plates an opposite ends of the tread, the at least one first rod being located adjacent a rear edge of the tread and being elevated above at least one second rod located below the tread, the at least one first rod being insertable through the pair of aligned holes in the side plates and into a hollow rung positioned opposite the tread, the at least one second rod being positioned to engage a front edge of the ladder to support the step platform extending beyond the front edge of the ladder.

12. The step platform of claim 11 wherein the at least one first rod comprises a first continuous rod extending between the opposite side plates.

13. The step platform of claim 12 wherein the first continuous rod includes locking clips at opposite ends thereof to prevent the first rod from migrating out of holes in either of the side plates.

14. The step platform of claim 12 wherein the at least one second rod comprises a second continuous rod extending through a second pair of aligned holes in opposite side plates.

15. The step platform of claim 14 wherein the second rod is identical to a first continuous rod positionable above the second rod.

16. The step platform of claim 14 wherein a series of pairs of aligned holes are located in a lower portion of the side plates, the second continuous rod being insertable through any of the series of aligned holes so that the orientation of the tread can be adjusted to remain substantially horizontal regardless of the angular orientation of the ladder.

17. The step platform of claim 11 wherein one of the side plates is adjustable laterally relative to the tread so that the step platform can be mounted on ladders having differing widths.

18. The step platform of claim 11 wherein each side plate includes a first section extending above the tread and rearwardly relatively to the tread, at least one hole being located in each first section.

19. The step platform of claim 11 wherein each side plate includes a folded section extending below the tread with fastening means connecting each folded section to the tread.

20. The step platform of claim 11 wherein the tread includes at least two laterally extending slots with fastening means extending through the slots to attach the tread to one of the side plates so that the lateral spacing of the side plates can be adjusted for mounting the step platform on ladders having different widths.

* * * * *